US008113512B2

(12) United States Patent
Ito

(10) Patent No.: US 8,113,512 B2
(45) Date of Patent: Feb. 14, 2012

(54) MEDIUM CONVEYANCE MECHANISM (DEVICE)

(75) Inventor: Kazuyoshi Ito, Gunma (JP)

(73) Assignee: OKI Electric Industry Co, Ltd., Tokyo (JP)

( * ) Notice: Subject to any disclaimer, the term of this patent is extended or adjusted under 35 U.S.C. 154(b) by 0 days.

(21) Appl. No.: 12/737,799

(22) PCT Filed: Jun. 17, 2009

(86) PCT No.: PCT/JP2009/061001

§ 371 (c)(1),
(2), (4) Date: Feb. 17, 2011

(87) PCT Pub. No.: WO2010/021194

PCT Pub. Date: Feb. 25, 2010

(65) Prior Publication Data

US 2011/0133388 A1 Jun. 9, 2011

(30) Foreign Application Priority Data

Aug. 21, 2008 (JP) ..... 2008-212475

(51) Int. Cl.
*B65H 9/16* (2006.01)

(52) U.S. Cl. ..... 271/248; 271/250

(58) Field of Classification Search ..... 271/248, 271/250

See application file for complete search history.

(56) References Cited

U.S. PATENT DOCUMENTS

| | | | | |
|---|---|---|---|---|
| 1,178,286 | A * | 4/1916 | Anderson | 271/250 |
| 4,637,602 | A * | 1/1987 | Gavaghan et al. | 271/238 |
| 5,180,154 | A * | 1/1993 | Malick | 271/2 |
| 6,971,647 | B2 * | 12/2005 | Jewell et al. | 271/240 |
| 2005/0017440 | A1 * | 1/2005 | Jewell | 271/250 |

FOREIGN PATENT DOCUMENTS

| | | | |
|---|---|---|---|
| JP | 59-102750 | A | 6/1984 |
| JP | 9-150993 | A | 6/1997 |
| JP | 11-301888 | A | 11/1999 |
| JP | 2002-249263 | A | 9/2002 |

* cited by examiner

*Primary Examiner* — David H Bollinger
(74) *Attorney, Agent, or Firm* — Rabin & Berdo, PC

(57) ABSTRACT

Aligning of banknotes is carried out without using an aligning device. A medium conveyance mechanism includes an upper belt (2) entrained around two rollers (3*a*, 3*b*), a lower belt (5) entrained around two other rollers (6*a*, 6*b*) and disposed so as to overlap the upper belt (2), and an aligning guide (15) disposed at one side of the upper belt (2) and the lower belt (5) at a distance therefrom, which aligning guide (15) has an inclined surface (16) for carrying out aligning of a banknote and a conveyance reference surface (17) formed at an end side of the inclined surface (16). When the banknote being conveyed abuts the inclined surface (16) of the aligning guide (15) for aligning, one side of the banknote is guided by the conveyance reference surface (17) while the banknote is slipped with respect to the upper belt (2) and the lower belt (5) in a direction orthogonal to a direction in which the banknote is conveyed.

2 Claims, 1 Drawing Sheet

MEDIUM CONVEYANCE MECHANISM (DEVICE)

TECHNICAL FIELD

The present invention relates to a medium conveyance mechanism (device) that conveys a medium such as a banknote, and particularly to a technique for stably conveying media of different sizes.

BACKGROUND ART

Conventional medium conveyance mechanisms (devices) handle tickets of different sizes, and are sized such that the width of opposing belts corresponds to the width of large tickets. Accordingly, in the case of conveying a large ticket by the opposing belts, the large ticket is conveyed so that a side thereof follows the surface of a guiding wall provided at a side of the opposing belts. When a small ticket is conveyed, on the other hand, because a space exists between the small ticket and the guiding wall surface, the small ticket is pressed against the guiding wall surface by an aligning device so that an edge of the small ticket follows the guiding wall surface. (See, for example, paragraph [0011] and FIG. 1 of Japanese Patent Application Laid-Open (JP-A) No. 2002-249263.)

SUMMARY OF INVENTION

Technical Problem

In the above-described conventional technology, however, a mechanism for operating the aligning device is necessary to press a banknote toward the guiding wall surface side by the aligning device, which increases the size and cost of the medium conveyance device. Further, in the case of a structure in which a banknote is held between and conveyed by rollers, even if the banknote held between the rollers is pressed by the aligning device, the banknote cannot be moved and fully pressed toward the guiding wall surface.

An object of the invention is to provide a solution to the above point.

Solution To Problem

An aspect of the invention is a medium conveyance mechanism including: a first conveyance belt entrained around at least two rollers; a second conveyance belt entrained around at least two rollers and disposed so as to overlap the first conveyance belt; and an aligning guide disposed at one side of the first and second conveyance belts at a distance therefrom, the aligning guide having an inclined surface for carrying out aligning of a medium and a conveyance reference surface formed at an end side of the inclined surface, wherein, when the medium being held between and conveyed by the first and second conveyance belts abuts the inclined surface for aligning, one side of the medium is guided by the conveyance reference surface while the medium is slipped with respect to the first and second conveyance belts in a direction orthogonal to a direction in which the medium is conveyed.

Advantageous Effects of Invention

With this structure, the invention can achieve size reduction since a member for aligning a medium such as an aligning device can be omitted.

DESCRIPTION OF EMBODIMENT

An embodiment of a medium conveyance mechanism (device) according to the invention will be described below with reference to the drawings.

Embodiment 1

Figure 1:
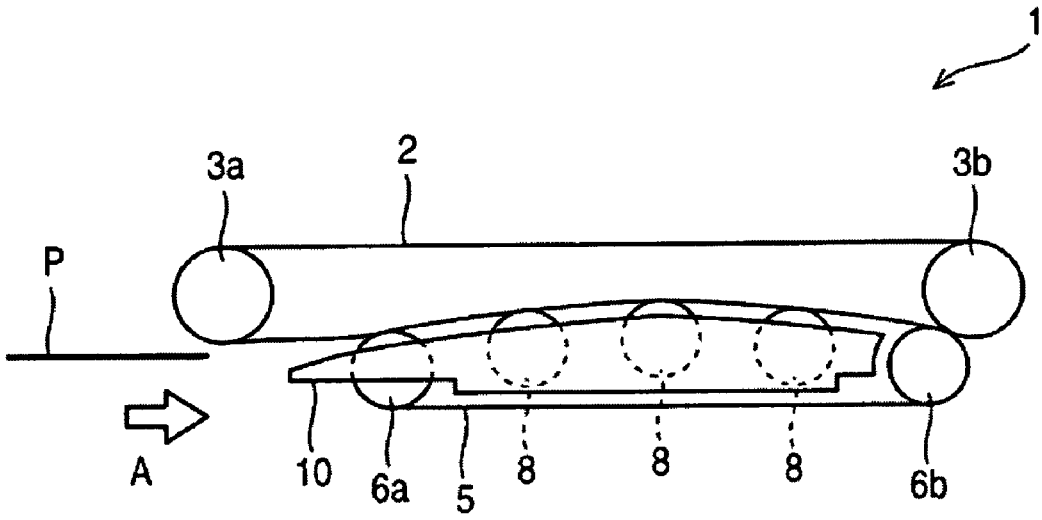
FIG. 1 is an explanatory view of a medium conveyance mechanism (device) according to Embodiment 1.

FIG. 1 is an explanatory view of a medium conveyance mechanism (device) 1 according to Embodiment 1. An upper belt (first conveyance belt) 2, which is an endless belt, is entrained around two rollers 3*a*, 3*b* and disposed at a position at which the upper belt 2 abuts an upper surface of a banknote P. The upper belt 2 is made to travel by an unillustrated drive mechanism driving the rotation of either one of the rollers 6*a*, 6*b*.

A lower belt (second conveyance belt) 5 is an endless belt that opposes the upper belt 2 from below, is disposed at a position at which the lower belt 5 abuts an undersurface of the banknote P, and is entrained around the rollers 6*a*, 6*b*. The lower belt 5 is made to travel by either one of the rollers 6*a*, 6*b* being rotated by an unillustrated drive mechanism. The upper belt 2 and the lower belt 5 are disposed such that portions thereof overlap each other, and convey the banknote with the overlapping portion holding the banknote therebetween.

Plural auxiliary rollers 8 are disposed at predetermined intervals between the rollers 6*a*, 6*b* around which the lower belt 5 is entrained. The auxiliary rollers 8 are disposed at positions slightly higher, namely further toward the upper belt 2, than the rollers 6*a*, 6*b*. Further, the auxiliary rollers 8 are disposed so that the positions thereof are gradually higher toward a substantially intermediate position between the rollers 6*a*, 6*b*. In this way, the overlapping portion of the upper belt 2 and the lower belt 5 has convex shape (i.e., take the shape that curves toward the upper belt 2).

By forming the overlapping portion of the upper belt 2 and the lower belt 5 into convex shape, approximately equal force is applied to every position of the upper belt 2 during conveyance of the banknote P. Thus, resistance against the conveyance of the banknote P is not generated, and constant force for conveying the banknote P is secured at every position. The interval between the auxiliary rollers 8 is smaller than a banknote P having the shortest side along a direction in which the banknote P is conveyed. The number of the auxiliary rollers 8 disposed is determined in accordance with this interval.

A conveyance guide 10 is disposed at both sides of the lower belt 5 with respect to the conveyance direction of the banknote P designated by arrow A. The conveyance guide 10 serves to support a portion of the undersurface of the banknote P that protrude from the lower belt 5. The conveyance guide 10 has a surface that is at substantially the same height as that of the surface of the lower belt 5 contacting the banknote P and, in the same way as the lower belt 5, is raised at an intermediate portion thereof between the rollers 6*a*, 6*b*. Further, the conveyance guide 10 has a surface that is inclined downward at an upstream side end in the conveyance direction of the banknote, such that the banknote P being conveyed is guided between the upper belt 2 and the lower belt 5.

Figure 2:
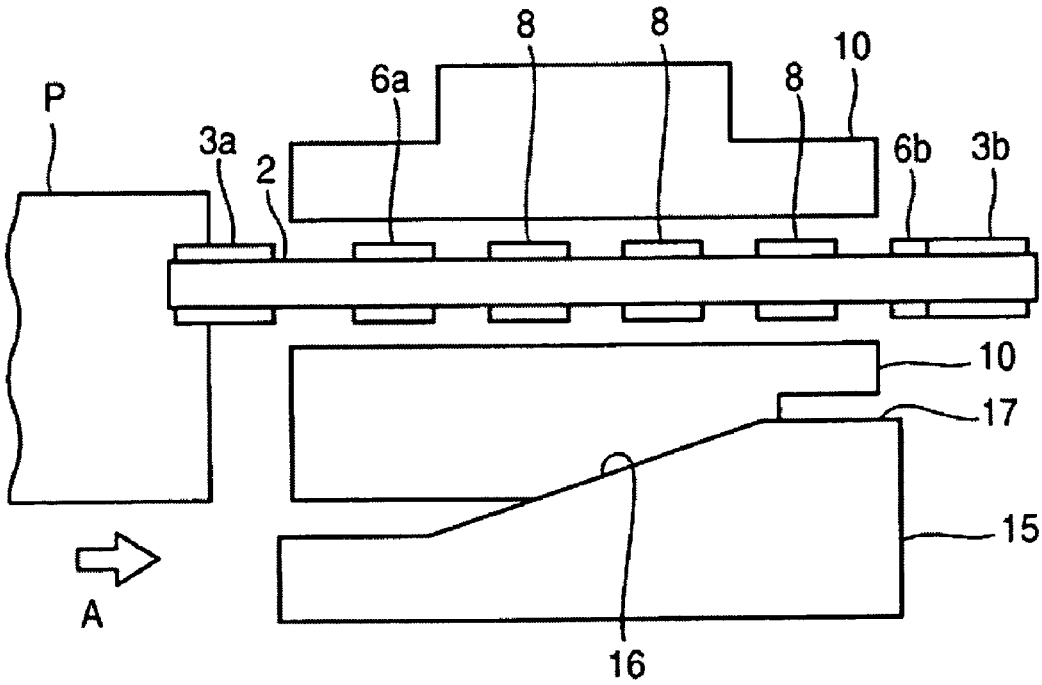
FIG. 2 is a top view of the medium conveyance mechanism (device) according to Embodiment 1.

FIG. 2 is a top view of the medium conveyance mechanism (device) according to Embodiment 1. In FIG. 2, an aligning guide 15 is disposed at either right or left side of the upper belt 2 and the lower belt 5, at a distance therefrom, with respect to the conveyance direction of the banknote P. The aligning guide 15 has an inclined surface 16 that is inclined towards the upper belt 2 and the lower belt 5 as it extends from the upstream to the downstream in the conveyance direction, and a conveyance reference surface 17 that connects to the inclined surface 16 at an end thereof to determine a transverse reference position for the banknote P with respect to the conveyance direction.

With the above-described structure of the aligning guide 15, the banknote P held between and conveyed by the upper belt 2 and the lower belt 5 comes into contact with the inclined surface 16, and is conveyed further from the inclined surface 16 while being aligned along the conveyance reference surface 17. In this way, the banknote P can be guided while being aligned in the conveyance thereof. Operation of the above-described structure will be described. When the banknote P is conveyed by the medium conveyance mechanism (device) of the invention in the conveyance direction of the banknote P designated by arrow A of FIG. 1, the banknote P is held and pulled in between the rollers 3*a* and 6*a*. Subsequently, the banknote P is conveyed by traveling of the lower belt 5 and the upper belt 2.

Since the aligning guide 15 extends toward the upper belt 2 and the lower belt 5, namely, the aligning guide 15 is inclined toward the banknote P being conveyed as it extends from the upstream to the downstream in the conveyance direction, the banknote P being conveyed is brought into contact with the aligning guide 15. The banknote P is conveyed so that an edge thereof follows the inclined surface 16 of the aligning guide 15, while being held between the upper belt 2 and the lower belt 5. However, the auxiliary rollers 8 are disposed at the lower belt 5, whereas no rollers other than the rollers 3*a*, 3*b* are disposed at the upper belt 2. With this structure, one side of the banknote P is guided toward the conveyance reference surface 17 while friction acting on the banknote P causes the banknote P to slip in a direction orthogonal to the conveyance direction.

Subsequently, the banknote P is conveyed along the conveyance reference surface 17 of the aligning guide 15. In this way, all the banknotes P are conveyed further while being aligned along the inclined surface 16 and the conveyance reference surface 17 of the aligning guide 15. As described above, the auxiliary rollers are disposed at the lower belt in the present embodiment. No rollers are disposed, on the other hand, at the upper roller other than the rollers around which the upper belt is entrained. In this way, frictional force acting between the upper roller and the banknote P is reduced, and the banknote P is conveyed while being slipped in the direction orthogonal to the conveyance direction when it abuts the aligning guide, and is aligned along the aligning guide. With this structure, no members for aligning the banknote P are necessary, and the size of the medium conveyance mechanism (device) can be reduced.

Additionally, the cost required for constructing the medium conveyance mechanism (device) can be reduced by omitting members for aligning the banknote P. Further, by forming the overlapping portion of the upper belt and the lower belt into convex shape, a case is prevented in which the belt is loosened by the banknote P entering between the upper belt and the lower belt, which leads to formation of a space between the opposing belts and thereby making holding of the banknote therebetween impossible.

The invention claimed is:

1. A medium conveyance mechanism comprising:

a first conveyance belt entrained around at least two rollers;

a second conveyance belt entrained around at least two rollers and disposed so as to overlap the first conveyance belt; and an aligning guide disposed at one side of the first and second conveyance belts at a distance therefrom, the aligning guide having an inclined surface for carrying out aligning of a medium and a conveyance reference surface formed at an end side of the inclined surface, wherein, when the medium being held between and conveyed by the first and second conveyance belts abuts the inclined surface for aligning, one side of the medium is guided by the conveyance reference surface while the medium is slipped with respect to the first and second conveyance belts in a direction orthogonal to a direction in which the medium is conveyed.

2. The medium conveyance mechanism according to claim 1, wherein:

a plurality of auxiliary rollers are disposed between the rollers around which the second conveyance belt is entrained, the auxiliary rollers being disposed at positions further toward the first conveyance belt than the rollers around which the second conveyance belt is entrained such that overlapping portion of the first conveyance belt and the second conveyance belt is formed into the shape that curves toward the first conveyance belt; and a conveyance guide is disposed at a side of the second conveyance belt to support an end of the medium at the time of aligning, the conveyance guide having a surface that curves toward the first conveyance belt so as to conform to the curved shape of the belts.

* * * * *